United States Patent [19]

Pietroni

[11] 3,993,257

[45] Nov. 23, 1976

[54] APPARATUS FOR THE SUPPLY AND AUTOMATIC UNLOADING OF REELS FOR AUTOMATIC WIRE COILING MACHINES

[75] Inventor: Piero Pietroni, Ascoli Piceno, Italy

[73] Assignee: Technofil S.p.A., Ascoli Piceno, Italy

[22] Filed: June 10, 1975

[21] Appl. No.: 585,677

[30] Foreign Application Priority Data

June 17, 1974 Italy ..... 3419/74

[52] U.S. Cl. ..... 242/25 R; 242/54 R

[51] Int. Cl.² ..... B65H 67/00

[58] Field of Search ..... 242/18 A, 18 R, 25 R, 242/25 A, 54 R

[56] References Cited

UNITED STATES PATENTS

| | | | |
|---|---|---|---|
| 1,964,530 | 6/1934 | Newton et al. | 242/25 R |
| 2,661,161 | 12/1953 | Hicks et al. | 242/25 R |
| 2,955,770 | 10/1960 | Ensor | 242/25 R |
| 3,113,739 | 12/1963 | Elder | 242/54 R |
| 3,118,627 | 1/1964 | Nelson et al. | 242/25 R |
| 3,137,452 | 6/1964 | Winders | 242/54 R |

*Primary Examiner*—John Petrakes
*Attorney, Agent, or Firm*—Browdy and Neimark

[57] ABSTRACT

An apparatus for the supply and automatic unloading of reels or similar devices for coiling machines of the type comprising at least one horizontal rotating axis designed to receive a reel for forming a coil of wire thereon, comprising a slideway for storing thereon and supplying therefrom reels with the reels so arranged that their axes are parallel to the rotating axis of the coiling machine, and being so inclined as to permit the rolling of the stored reels to the slideway outlet station under the effect of gravity, with means being provided for ensuring the supply of one reel only at a time and its transfer from the outlet station to a lifting station where a rotating lifting device lifts the single reel to a position coaxial with the rotating axis of the coiling machine. The lifting device ensures at the same time the unloading of the completed coil and its transfer to an unloading station, with all the steps being carried out in perfect synchronism with the movements of the wire coiling machine.

10 Claims, 6 Drawing Figures

APPARATUS FOR THE SUPPLY AND AUTOMATIC UNLOADING OF REELS FOR AUTOMATIC WIRE COILING MACHINES

BACKGROUND OF THE INVENTION

The present invention relates in general to wire coiling machines and in particular to an apparatus for the supply and automatic loading and unloading of reels and similar devices for automatic wire coiling machines and in particular for metal wire coiling machines.

DESCRIPTION OF THE PRIOR ART

As known, wire coiling machines of the above type essentially comprise a rotating axis for receiving the coil-supporting reel and a wire guide, in general of the carriage type, motor-driven so as to be able to travel automatically along a segment parallel to the axis of the coil and of equal length, from one end to the other one and back, with the speed of its motion, which is adjustable, determining the pitch of the winding.

The wire coiling machines I here refer to are those comprising at least one rotating horizontal axis designed to receive and carry the supporting reel of the coil to be wound.

The loading and unloading of the reel on which the coils are formed is normally done by manually controlled conventional means, for example, lift trucks, without any coordination between this operation and the machine phase, with considerable machine idle time especially with single-axis coiling machines and with the possible danger of faulty operation when the control is entrusted exclusively to the machine attendant's skill.

SUMMARY OF THE INVENTION

It is a principal object of the present invention to obviate the drawbacks outlined herein above and to propose here an apparatus ensuring the automatic supply to and loading and unloading of reels or similar devices for supporting the coils formed by a coiling machine of the above-mentioned kind, in perfect synchronism with the operating phases of the machine.

It is a further object of the present invention to supply an apparatus suitable for the above purpose, the said apparatus being extremely simple in construction and safe to operate and economical in making.

The above objects and still other ones which will become evident from the following description, are realized by the apparatus of the present invention which, substantially, comprises a slideway for storing and feeding the reels with the reels arranged in line with their axes parallel to the rotating axis of the wire coiling machine, the slideway being so inclined as to allow the reels to roll by gravitational pull alone to the reel outlet station; means for intercepting the reels moving along the slideway to ensure that only one reel at a time reaches the outlet station of the slideway; transfer means for receiving the single reel leaving the outlet station and to transfer it to the lifting station below the rotating axis of the coiling machine; a rotating lifting device subjected to the action of electromagnetic control means ensuring its alternating rotation in either direction around its rotational axis for transferring, along a wall running alongside the path the reel is travelling along when being removed from the transfer means on the lifting station to a position coaxial to the rotating axis of the coiling machine, the lifting device being in addition subjected to the action of end-of-operation cycle control devices, part of the coiling machine, for the removal of the completed reel and its transfer from the position coaxial to the rotating axis of the wire-coiling machine to a position on the transfer means.

BRIEF DESCRIPTION OF THE DRAWINGS

The apparatus object of the present invention will be still better understood from the following description of a preferred embodiment thereof without being limited thereto and on hand of the accompanying drawings in which.

DESCRIPTION OF THE PREFERRED EMBODIMENTS

Figure 1:
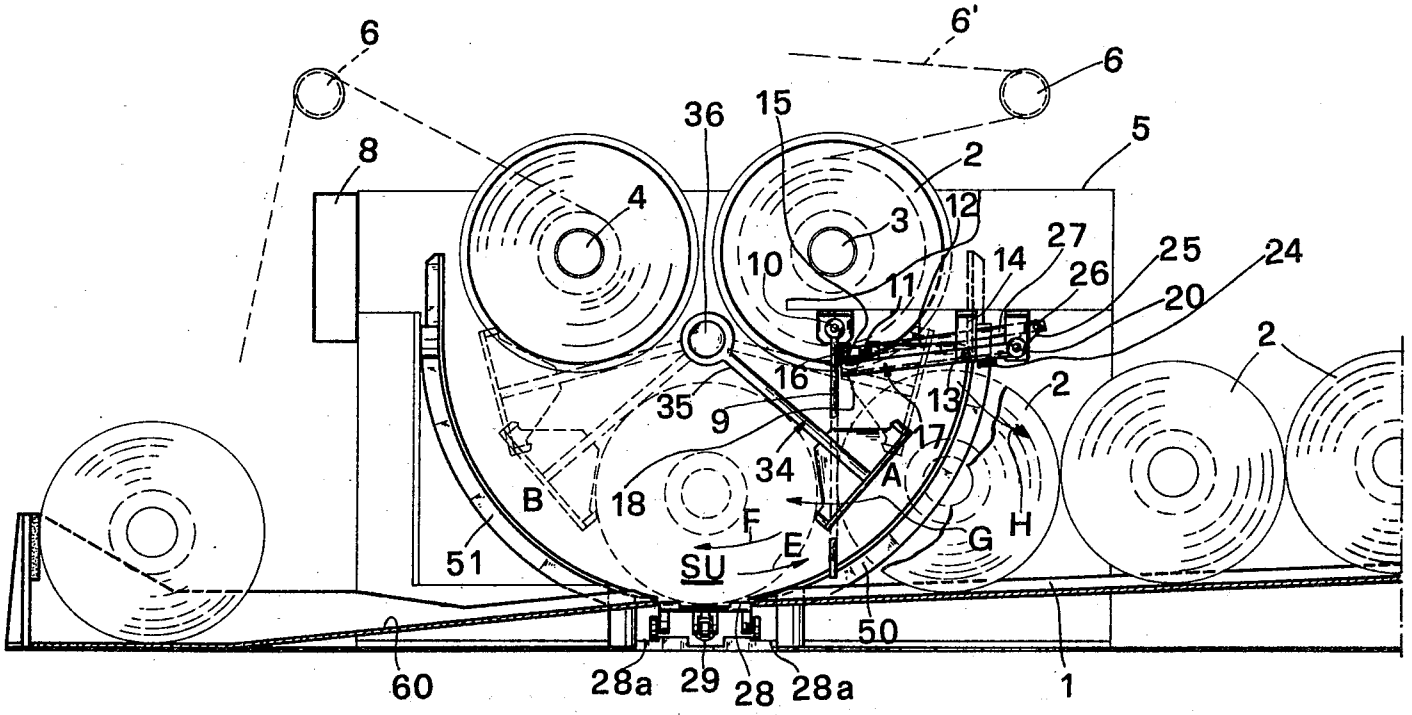
FIG. 1 is the apparatus of the present invention together with a wire coiling machine having two parallel rotating, horizontal axes seen from the front with parts in section.
Figure 2:
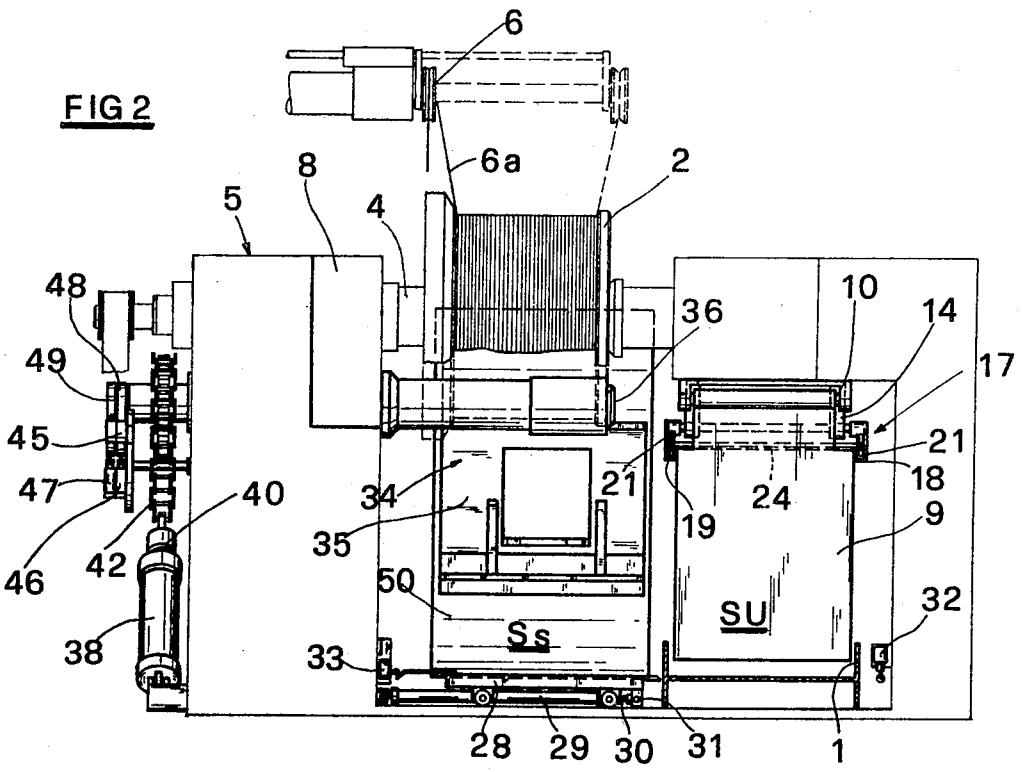
FIG. 2 is the apparatus and machine of FIG. 1 in side elevation

Referring now to the figures and in particular to FIGS. 1 and 2, the apparatus object of the present invention comprises a slideway 1 for storing a series of reels 2 with their axes in parallel to the two rotating axes 3 and 4 of a coiling machine 5 of the type in which the wire is alternatingly coiled on reels carried by the two axes without interrupting the cycle, that is, once the coil on the reel carried by an axis, for example axis 3, is completed, the winding of a second coil on the other axis, that is, axis 4, will automatically start and, after completion, the cycle will again switch over to axis 3 and so on.

A wire-guide 6 operating according to technical arts well known and positioned close to the two axes 3, 4 driven by automatic means not described because not being part of the present invention, allow the wire arriving from a suitable magazine to be wound up as desired on the reels carried by the axes 3 and 4.

The said wire guide 6 during coiling moves along a segment parallel to the said axes and of length equal to the distance between the flanges of the reels, following an alternating motion, the speed of which determines the coiling pitch.

In addition, the said wire guide 6 is fitted with a control apparatus generally indicated by 8 which, when preset as required in function of the number of strokes covered by the wire guide 6 during the coiling phase determines the end of the coiling cycle and controls at the same time the movement of the wire guide 6 to the position ensuring the coiling up of the wire onto the reel carried by the other axis.

The slideway 1 is so inclined that the reels 2 under the effect of the gravitational pull tend to roll to the outlet station S*u* in the same slideway 1.

At 9 there is a diaphragm positioned on the top and above the slideway 1 and crosswise thereto designed to intercept the reels 2 rolling toward the station S*u*.

The diaphragm 9 is hinged at 10 to the structure carrying the apparatus and connected also to the piston rod 11 of a hydraulic cylinder 12 hinged at 13 to a bracket 14 fixed to the carrying structure of the apparatus; the rod 11 in the here shown embodiment is hinged at 15 to a support 16 fixed in turn to the said diaphragm 9.

Figure 3:
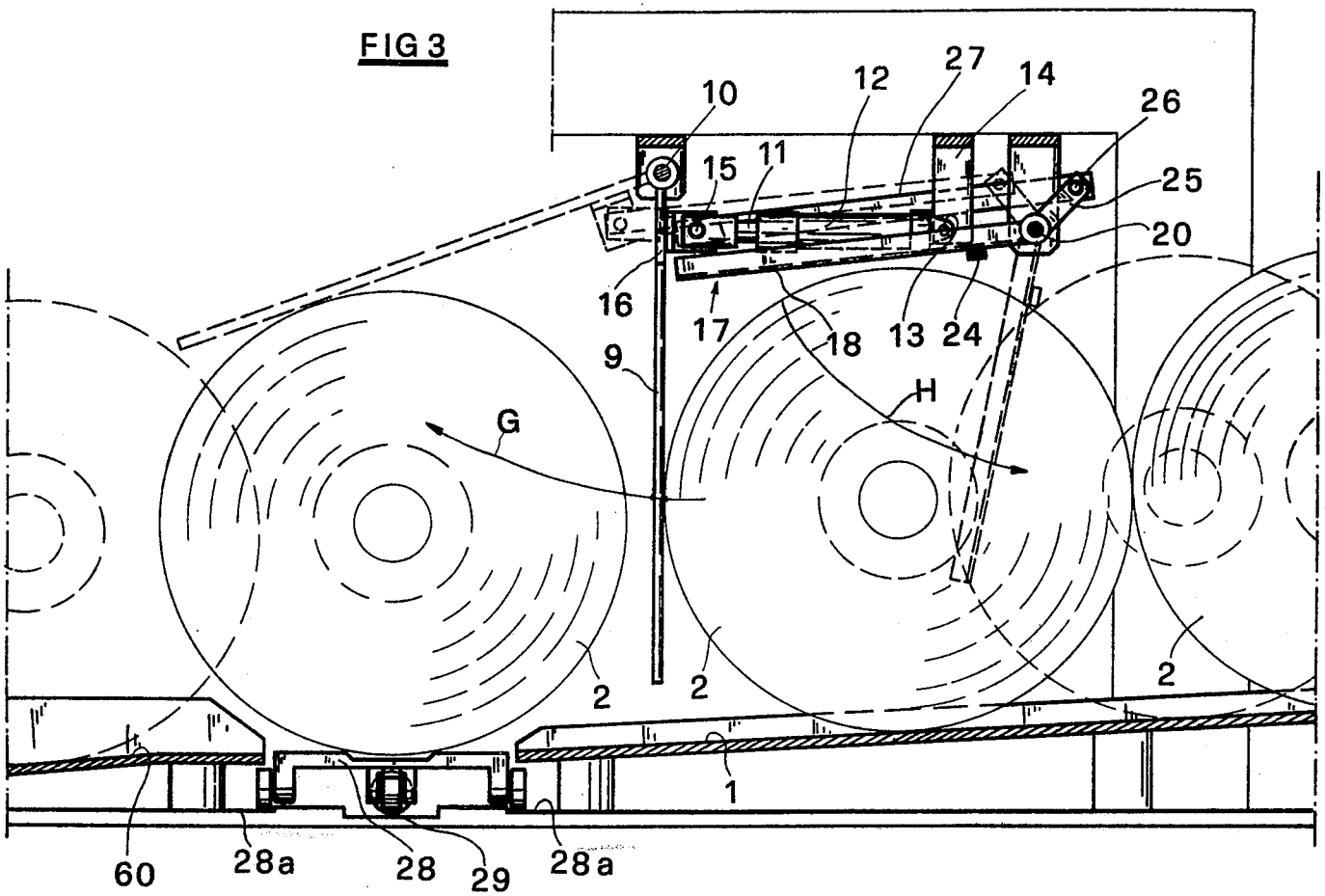
FIG. 3 is the front view of the reel supply group and transfer carriage leading from the slideway to the lifting station.
Figure 4:
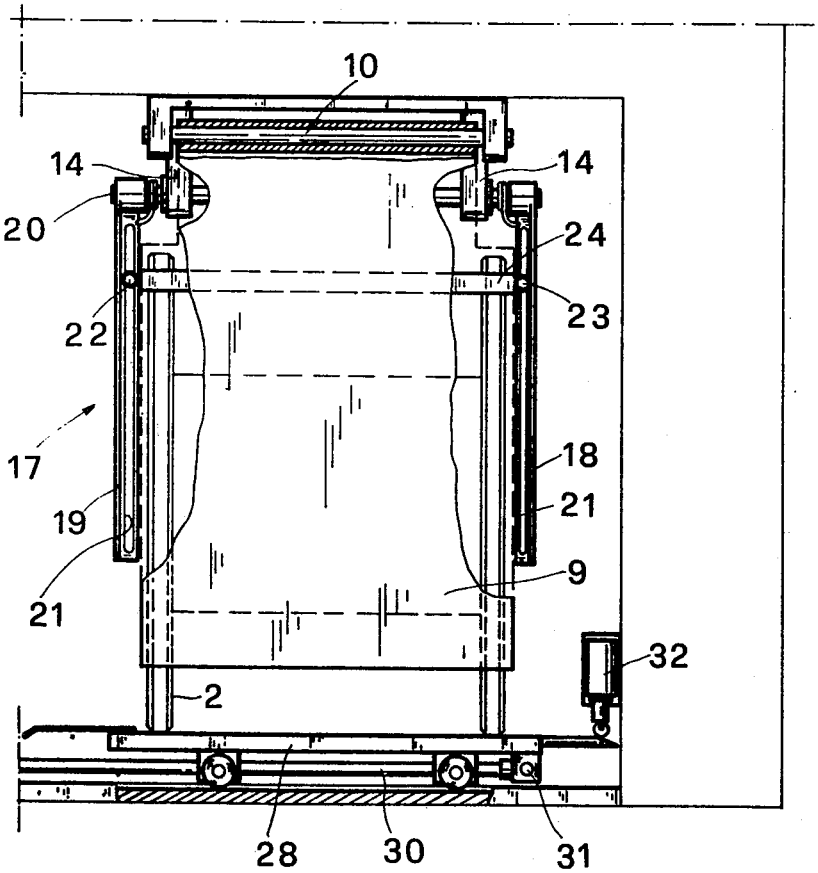
FIG. 4 is a side view of the detail of FIG. 3 partly in section.

In FIGS. 3 and 4 at 17 there is shown a fork with two arms 18 and 19, hinged at 20 to the structure carrying the apparatus and positioned on top and above of the slideway 1 upstream of the said diaphragm 9 when looked at in the direction of flow of the reels 2 rolling along the said slideway 1.

The arms 18 and 19 are provided longitudinally with corresponding slits 21 for receiving slidingly but with the possibility of being fixed thereto, two pins 22 and 23 carried by a bar 24 crosswise to the slideway 1 as will be described in more detail hereinbelow.

The fork 17 carries in addition an arm 25 having hinged thereto at one end at 26 a tie rod 27 engaged at the other end at 15 to the diaphragm 9.

At 28 there is shown a carriage 28 positioned at the outlet station S*u* of the slideway 1 so arranged that it can travel along a pair of guideways 28*a* in two directions perpendicular to the slideway 1.

The said carriage 28 is driven by means of a hydraulic piston operating in cylinder 29 carried by the structure of the apparatus with its piston rod 30 hinged at 31 to a bracket being integral part of the carriage 28.

At 32 and 33 there are two microswitches which can be engaged by the carriage 28 during its travel as will be described hereinafter.

At 34 there is shown a lifting device corresponding to a lifting station $S_s$ connected to the travelling path of the carriage 28 and positioned below the axes 3 and 4.

The said lifting device 34 substantially consists of an arm 35 fixed to one end of a shaft 36 carried, in the here shown embodiment, by the structure of the machine the apparatus here described is part of.

Figure 5:
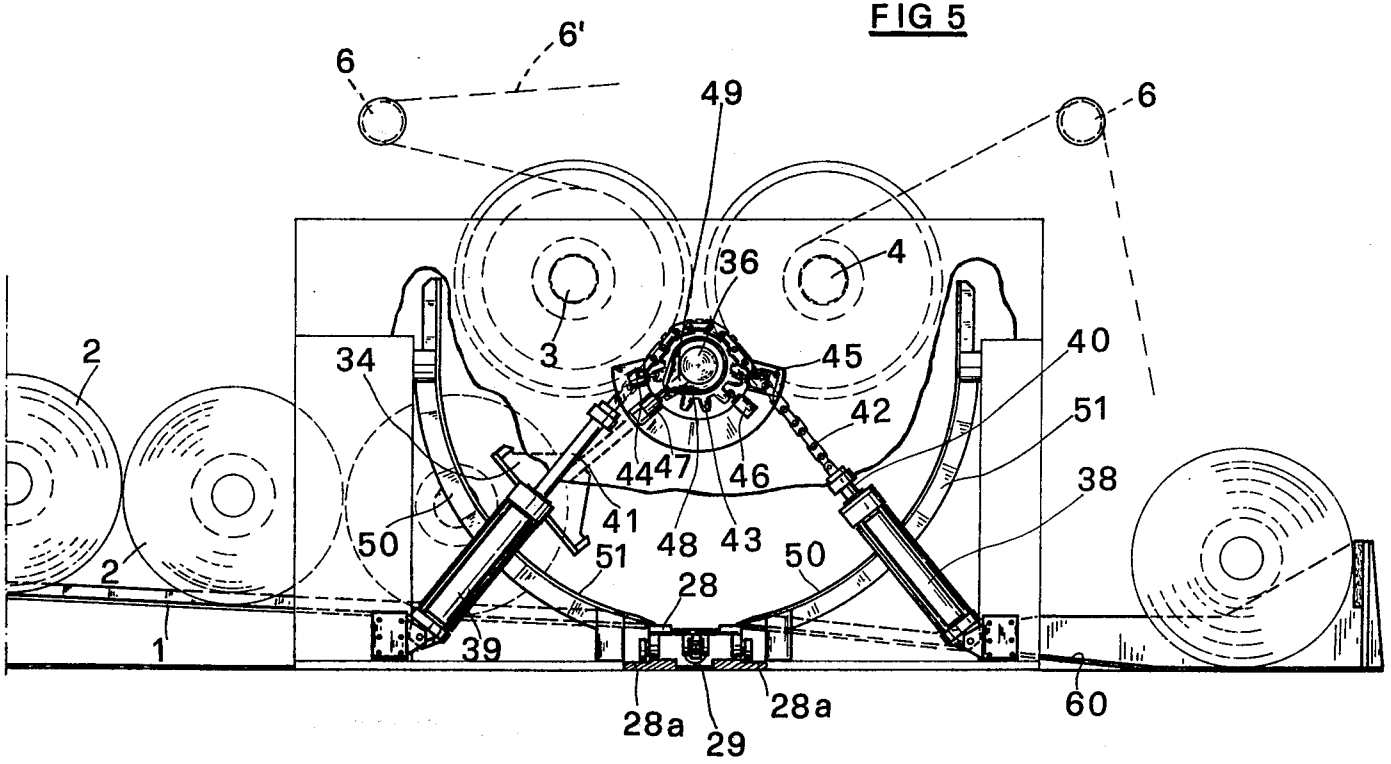
FIG. 5 is a rear view of the apparatus and machine evidencing the drives of the lifting device.

The arm 34 has impressed thereon a pendular movement obtained by the pistons of the hydraulic cylinders 38 and 39 fixed in the case here shown to the structure of the machine with the piston rods 40 and 41 reciprocally connected by a length of chain 42 which is wound up on a sprocket 43 keyed to the shaft 36 (see FIG. 5).

At 44, 45, 46, 47 there are shown four microswitches arranged in couples, engaged by two tracers 48 and 49 part of the shaft 36, during rotation of the latter: the tracer 48 intercepts the microswitches 44 and 46, the tracer 49 the microswitches 45 and 47.

The said microswitches control the movements of the lifting device 34.

50 and 51 indicate two arched walls in proximity of the lifting station $S_s$ provided to form the raceways for the reels when being transferred from the said lifting station to a position which is coaxial with the rotating axes 3 and 4 of the machine.

With reference to the above specification we shall now describe the operation of the apparatus assuming the following starting situation:

The control apparatus 8 reads the end of a coiling cycle after completion of a reel 2 carried by the axis 3, the lifting device 34 is in the position A shown in FIG. 1 and the circuit carrying the microswitches 45 and 47 is disengaged; the carriage 28 is near the station $S_s$, the diaphragm 9 intercepts the reels 2 on the slideway preventing the same from advancing, the fork 17 is raised, that is, does not intercept the reels 2 on the slideway 1.

Following the consent given by the control apparatus 8 the piston of the cylinder 38 withdraws the piston rod 40 together with the length of chain 42 causing thus the sprocket wheel 43 to rotate together with the shaft 36 and the lifting device 34 in direction of the arrow E shown in FIG. 1.

The rotation of the lifting device 34 continues until the tracer 48 intercepts the microswitch 44 stopping the stroke of the piston within the cylinder 38 and stopping at the same time the lifting device 34 which is now at the axis 3 below the reel 2 on which the coil has been wound.

At this point, controlled by suitable control devices not shown because they comprise known integral parts of the coiling machine, the axis 3 releases its grip on the reel 2 which remains on the lifting device 34 resting against the wall 50; a successive control pulse to the cylinder 39 causes its piston rod 41 to be withdrawn together with the length of chain 42, rotating the shaft 36 and therewith the lifting device 34 in direction of the arrow F shown in FIG. 1, rotation which will continue until the tracer 48 engages the microswitch 46.

The engagement of the microswitch 46 causes the piston rod of the cylinder 39 to stop and stop too the rotation of the lifting device 34 with the reel 2 following the lifting device 34 and rolling along the wall 50 comes to rest on the carriage 28.

The microswitch 46 when engaged by the tracer 48 causes not only the lifting device 34 to stop, but also the engagement of the piston of cylinder 29; consequently the piston rod 30 leaves the said cylinder 29, and the carriage 28 together with the reel 2 travel from the lifting station $S_s$ to the outlet station S*u* of the slideway 1.

The carriage 28, during its travel, engages the microswitch 32 which stops the motion of the piston in cylinder 29 and therewith the motion of the carriage 28 engaging at the same time the piston of cylinder 12.

This causes the piston rod 11 to leave the cylinder 12 and the diaphragm 9 to rotate in the direction of the arrow G shown in FIGS. 1 and 3.

The diaphragm 9 when moving pushes the reel 2 on the carriage 28 onto a discharge channel 60 allowing at the same time another reel 2 at the head of the line of reels on the slideway 1 to be discharged onto the carriage 28.

Rotating together with the diaphragm 9, the fork 17 rotates now in direction of the arrow H as shown in FIGS. 1 and 3 carrying the bar 24 into a position where it will intercept the reels rolling along the slideway 1 and prevent them from reaching the outlet station S*u*.

When the new reel released by the diaphragm 9 comes to rest on the carriage 28, the piston of cylinder 29 is again engaged and the piston rod 30 drawn back into the cylinder causing the carriage 28 to travel from the station S*u* to the station $S_s$.

During its motion the carriage 28 engages the microswitch 33 stopping the piston inside the cylinder 29 and thereby stopping also the carriage 28 and engaging the piston of the cylinder 38.

This causes again rotation of the lifting device 34 in direction of the arrow E, removal of the reel 2 on the carriage 28 and its rolling along the wall 50 to a position coaxial to that of axis 3.

When the tracer 48 engages the microswitch 44, the lifting device 34, under the action of the control devices not shown because they are an integral and known part of the coiling machine, stops and the reel 2 is now received by the axis 3.

At the same time the diaphragm 9 returns to its original position and, because of the return of the fork 17 to its original position, a new reel will come to rest thereon.

At the end of this phase the piston of the cylinder 39 is again engaged followed by rotation of the lifting device 34 in the direction of the arrow F as before until the tracer 48 engages the microswitch 46 stopping the lifting device 34 in the position B as shown in FIG. 1.

Under this condition the lifting device 34 is preset to take up, when receiving the respective pulse signal, the reel 2 carried by the axis 4 on which a new coil is now being formed.

When the control system 8 indicates again the end of the coiling cycle, the circuit carrying the microswitches 45 and 47 is engaged and that carrying the microswitches 44 and 46 disengaged; after engagement of the piston of cylinder 39, the lifting device 34 rotates in the direction shown by the arrow F until the tracer 49 engages the microswitch 45 and stops the movement of the lifting device 34.

Thus, once the reel 2 carried by the axis 4 is transferred to the lifting device 34 leaning against the wall 51, and when induced by the piston of the cylinder 38, the lifting device will now rotate in direction of the arrow E until the tracer 49 trips the microswitch 47, this is happening when the reel 2 accompanied by the lifting device 34 rolls along the wall 51 comes to rest on the carriage 28.

At this point, as before, the carriage 28 is transferred from the station $S_s$ to the station $Su$, followed by a new rotation of the diaphragm 9 and fork 17 with the therefrom ensuing unloading of the formed coil in rest on the carriage 28 from the carriage, then moving the carriage from the station $Su$ to the station $S_s$, a new rotation of the lifting device 34 as shown by the arrow F until the mircoswitch 45 is tripped by the tracer 49 when the new reel is in coaxial position to the axis 4.

At this point the control devices not shown because part of the coiling machine move the reel to the axis while the lifting device 34 upon impulse by the piston of the cylinder 38 returns to the position A.

As soon as the control apparatus 8 indicates a new end of cycle of the reel supported by the axis 3 the cycle beginning at the hereinabove assumed position will repeat itself.

Figure 6:
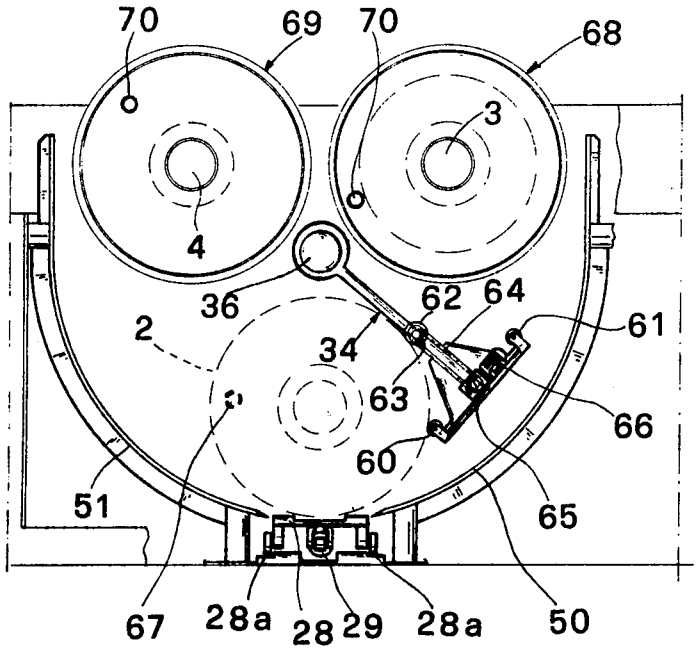
FIG. 6 shows the rotating lifting device according to an embodiment in which the reels carried by the axes of the machine are rotated by the same by means of a striker fitted to the pulling mandrel interacting with a striker on the flange of the reel facing the mandrel.

According to the embodiment shown in FIG. 6, the lifting device 34 is so designed as to satisfy the necessity of rotating a reel 2 so as to be acceptable either by axis 3 or by axis 4, by having a striker fitted to the reel engage with a striker fitted to the pulling shaft with the reel being caused to rotate by the engagement of the strikers.

There are in fact coiling machines in which the reel supporting axis is provided with a pulling mandrel fitted with a projection capable to engage a recess or seat provided for this purpose on the flange of the reel turned toward the mandrel so as to form a stable coupling between reel and mandrel and prevent possible rotation or sliding between mandrel and reel during coiling.

The lifting device 34 in this embodiment shown in FIG. 6 carries three rollers 60, 61, 62, with the rollers 60, 61 being idlers and the roller 62 kinematically connected by a first sprocket wheel 63, a chain 64 and a second sprocket wheel 65 to a gear motor 66 carried by the lifting device 34.

Once a reel 2 has been transferred from the station $S_s$ to a coaxial position to one of the two axes 3 or 4 as controlled by the control devices built into the gear motor 66 supply circuit, the gear motor is engaged and causes the rotation of the roller 62 which in turn ensures the reel 2 to rotate by friction effect.

The rotation will continue for example until the seat 67 provided on the reel 2 near the flange turned toward the mandrels 68 and 69 associated with the axes 3 and 4 coaxial to the reel, reaches the coupling projection 70 fitted to the mandrel.

At the end of this phase the gear motor 66 stops and, engaged by the mentioned control devices part of the coiling machine, the reel 2 is now engaged by either the axis 3 or the axis 4 coaxial thereto, while the coupling projection 70 is inserted into a seat 67 on the reel 2.

The above description clearly shows that the apparatus of the present invention fully satisfies the proposed objects.

Supply to, loading and unloading of the reels and finished coils are in fact entirely automatic and in perfect synchronism with the operating phases of the wire coiling machine excluding errors in manual control.

Obviously the present invention is not limited to the here described embodiments; it is understood that constructional variations are possible and foreseen: for example, the apparatus may be designed for the supply to, loading and unloading of reels to a single-axis wire coiling machine, or may have the tracers 48 and 49 each one formed by a pair of staggered cams, so as to vary the time of tripping of the microswitches 44 and 46 or else 45 and 47 to modify the amplitude of the angular rotation of the lifting device 34 in function of the diameter of the reel to be supplied to the coiling machine, without leaving the protection range of the present invention and the claims made hereinafter.

What we claim and desire to secure by Letters Patent is:

1. An apparatus for the loading and automatic unloading of reels or similar components for coiling machines of the type comprising at least one rotating horizontal axis for receiving a reel for supporting the coil to be formed thereon, comprising:

a slideway for storing thereon and supplying therefrom the empty reels with the reels being so arranged that their axes are parallel to the rotating axes of the coiling machine, said slideway being so inclined as to consent the feed of the reels by gravity to an outlet station of said slideway;

intercepting means for intercepting the reels rolling along said slideway for ensuring that only one reel a time arrives at the outlet station of said slideway;

transfer means designed for receiving a single reel leaving the outlet station of said slideway for transferring it from the said outlet station to a lifting station below the rotating axes of the coiling machine and for transferring coiled rolls from the lifting station to said outlet station; and a rotating lifting means for removal of completed coiled reels from the position coaxial to the rotating axis of the coiling machine to a position of stable rest on said transfer means and for transferring empty reels from said transfer means to a position coaxial with the rotating axis of the coiling machine.

2. An apparatus according to claim 1, wherein said transfer means for the single reels arriving at the slideway outlet station comprise a movable carriage positioned coplanarly to said slideway but crosswise thereto, said carriage being capable of alternate travel along a horizontal direction normal to said slideway.

3. An apparatus according to claim 1, wherein said rotating lifting means comprises roller means for rotating the reel subjected to the action of said rotating lifting means, after having been lifted to a position coaxial with the rotating axis, to a position wherein a striker element provided on the reel becomes aligned with respect to a striker element part of the axis.

4. An apparatus in accordance with claim 1, wherein said intercepting means also functions to cause removal of coiled rolls, transferred to said outlet station by said transfer means, before permitting another empty reel to arrive at said outlet station.

5. An apparatus according to claim 4, wherein the intercepting means on said slideway comprises a diaphragm on the top and above said slideway positioned crosswise thereto, pivoted to the structure of the coiling machine and rotatable in both directions around an axis normal to the flow of the reels on said slideway; thrust means for acting on said diaphragm to make it take up in successive phases a stable intercepting position with respect to the reels rolling along said slideway, or a stable position of non-interception of the reels; a fork with two arms positioned on top of and above said slideway upstream of said diaphragm in direction of the flow of the reels, supported by the structure of the coiling machine and rotatable in both directions, said two arms forming the sliding guideways for a bar positioned crosswise to said slideway, stabilizable at different predetermined levels of said arms, said fork being connected to said diaphragm in such a manner as to rotate together with said diaphragm but in the opposite direction thereof.

6. An apparatus according to claim 5, wherein said thrust means comprise a hydraulically controlled piston rod of which is connected to the said diaphragm, slidingly seated within a cylinder supported by the structure of the coiling machine.

7. An apparatus in accordance with claim 4, further including control means for sequentially activating said rotating lifting device to remove the coiled roll after the roll has completed being coiled, activating said transfer means to transfer the completed coil to said outlet station, activating said intercepting means for removing said completed reel and admitting an empty reel to said outlet station, activating said transfer means to transfer the empty reel to the lifting station, and activating the said rotating lifting means to transfer the empty reel to a position coaxial with the rotating axis of the coiling machine.

8. An apparatus according to claim 7, wherein the intercepting means on said slideway comprises a diaphragm on the top and above said slideway positioned crosswise thereto, pivoted to the structure of the coiling machine and rotatable in both directions around an axis normal to the flow of the reels on said slideway; thrust means for acting on said diaphragm to make it take up in successive phases a stable intercepting position with respect to the reels rolling along said slideway, or a stable position of non-interception of the reels; a fork with two arms positioned on top of and above said slideway upstream of said diaphragm in direction of the flow of the reels, supported by the structure of the coiling machine and rotatable in both directions, said two arms forming the sliding guideways for a bar positioned crosswise to said slideway, stabilizable at different predetermined levels of said arms, said fork being connected to said diaphragm in such a manner as to rotate together with said diaphragm but in the opposite direction thereof.

9. An apparatus according to claim 7, wherein said thrust means comprise a hydraulically controlled piston the rod of which is connected to said diaphragm, slidingly seated within a cylinder supported by the structure of the coiling machine, said piston being connected to said control means for operation in perfect synchronism with said transfer means.

10. An apparatus according to claim 7, wherein said transfer means for the single reels arriving at the slideway outlet station comprise a movable carriage positioned coplanarly to said slideway but crosswise thereto, said carriage being capable of alternate travel along a horizontal direction normal to said slideway, said carriage being connected to said control means for operation in perfect synchronism with the movement of said rotating lifting means.

* * * * *